United States Patent [19]

Weigl et al.

[11] 4,101,904

[45] Jul. 18, 1978

[54] MAGNETOGRAPHIC IMAGING MEMBER AND THE METHOD OF ITS USE

[75] Inventors: John Wolfgang Weigl, West Webster; Joseph Mammino, Penfield, both of N.Y.

[73] Assignee: Xerox Corporation, Stamford, Conn.

[21] Appl. No.: 690,453

[22] Filed: May 27, 1976

[51] Int. Cl.[2] ..... G03G 19/00

[52] U.S. Cl. ..... 346/74.1; 360/59

[58] Field of Search ..... 346/74.1; 360/59, 131

[56] References Cited

U.S. PATENT DOCUMENTS

| | | | |
|---|---|---|---|
| 2,793,135 | 5/1957 | Sims | 346/74.1 |
| 3,824,601 | 7/1974 | Garland | 346/74.1 |
| 3,987,491 | 10/1976 | Nelson | 346/74.1 |
| 3,993,484 | 11/1976 | Rait et al. | 346/74.1 |
| 4,005,439 | 1/1977 | Levy | 346/74.1 |

*Primary Examiner*—Jay P. Lucas

*Attorney, Agent, or Firm*—James J. Ralabate; Peter P. Eichler

[57] ABSTRACT

A magnetographic imaging member is provided which includes a photoconductive layer sandwiched between a transparent conductive substrate and an overcoating of magnetic particles dispersed in a dielectric material. A magnetic latent image is formed in the member by first producing an electrostatic latent image on the pre-magnetized dielectric coating and developing it with a thermal radiation reflective toner. The surface is then subjected to thermal radiation which demagnetizes the pigment in the overcoating by raising it to a temperature above its Curie point except in the areas where the developed electrostatic image reflects the heat. The latent magnetic image can be repetitively developed with magnetic toner.

3 Claims, 11 Drawing Figures

MAGNETOGRAPHIC IMAGING MEMBER AND THE METHOD OF ITS USE

BACKGROUND OF THE INVENTION

This invention relates generally to magnetic imaging and more particularly to an improved magnetographic imaging member and the method of its use.

There has recently been introduced a magnetic imaging system which employs a latent magnetic image in a magnetizable record surface. The latent image can be used for electronic transmission purposes or in a duplicating process.

In the duplicating process the image is developed with a magnetic toner. It is sometimes repetitively developed with transfer of the toner to a receiving surface taking place between each development.

Such a latent magnetic image is provided by any suitable magnetization procedure. Typically, a magnetizable layer of marking material is arranged in imagewise configuration on a magnetic substrate. Well known electrostatographic methods are sometimes used to arrange the magnetizable material in imagewise configuration. The imagewise configuration of magnetizable particles is converted to a magnetic latent image in the imaging surface by methods more fully described in U.S. Pat. Nos. 3,749,833 and 3,804,511 to Rait et al.

In one such method the magnetizable toner is developed in image configuration onto a xerographic recording surface. The toner is then magnetized by, for example, an electronic recording head. The layer supporting the magnetized toner is next brought into contact with a magnetizable layer, and the magnetized toner magnetizes the magnetizable layer in image configuration. A latent magnetic image is thus formed in the magnetizable layer corresponding to the imagewise arrangement of magnetized toner particles.

In another such method an imaging surface which is both magnetizable and xerographically imageable is used. Such an imaging surface comprises, for example, a mixture of iron oxide and zinc oxide supported on a substrate. A xerographic imaging is developed on the surface using magnetizable toner. The imaging surface and the magnetizable toner are then, sequentially, uniformly magnetized from the back with a recording head and uniformly erased from the front with a recording head. The magnetized toner particles act as a shunt for the erase head and prevent erasure of the magnetized surface in the developed image areas, thus forming a magnetic latent image.

Such surfaces which comprise a combination of magnetizable particles and photoconductive particles in a binder typically have low mechanical strength. A useful amount of magnetizable particles and photoconductive particles (generally about 30wt.% each) does not leave room for sufficient binder to form a strong layer.

It is also well known in the art to form a latent magnetic image by selective Curie point erasure of a premagnetized layer. Curie point erasure is accomplished by heating a premagnetized layer of magnetic material. When a magnetized material is heated past the Curie temperature it will lose its magnetism.

Curie point erasure of a unifomly magnetized hard magnetic material to achieve a latent magnetic image is typically accomplished by applying radiant heat through a mask. The magnetism in the material is erased by the heat except in the areas where the heat is prevented by the mask from heating the material.

The forming of a latent magnetic image by Curie point erasure has many advantages. It can be quickly accomplished, and the images so formed have high resolution and are desirable and convenient for use especially in duplicating systems where many copies are made from a single master.

Although good results are observed in the use of a latent magnetic image formed by the Curie point erasure system, there are certain disadvantages which are sought to be overcome. The use of a separate mask material to place over the magnetized material prior to heating is sometimes inconvenient. Such a separate mask requires close registration between the mask and the magnetic material during heating. The thickness of the separate mask does not contribute to high resolution because of the spacing between the mask image and the surface of the magnetic material, especially when the mask image is coated onto a transparent layer. The selection of a heat transmitting material to support the mask is known to present materials problems.

The commonly assigned copending applications Ser. No. 672,809 filed Apr. 1, 1976 now abandoned in favor of continuing application Ser. No. 726,853 filed Sept. 27, 1976. describe certain significant improvements over other Curie point erasure systems of the prior art. However, that system incorporates a spacing between the thermal radiation reflective mask and the conductive pre-magnetized layer.

A magnetic member which can be imaged by the Curie point erasure method without the use of a separate mask member is desirable. It is also desirable to provide a method of forming a latent magnetic image by Curie point erasure in which the mask is as close as possible to the magnetic layer so that resolution is improved. It is further desirable to provide a magnetographic imaging surface which can be imaged by the Curie point erasure method while avoiding the use of an image mask held on a separate heat transmitting layer.

SUMMARY OF THE INVENTION

It is an object of the invention to provide a magnetograhic imaging member.

It is another object of the invention to provide a magnetographic imaging member on which a latent magnetic image can be formed by Curie point erasure through a mask.

It is a further object of the invention to provide a magnetographic imaging member on which a latent magnetic image is formed by Curie point erasure through a mask which is formed directly on the imaging member.

It is also an object of the invention to provide a method for forming a magnetic latent image on a magnetographic imaging member.

It is yet another object of the invention to provide a method for forming a heat reflective mask directly on a magnetographic imaging member, the mask being suitable for use in Curie point erasure to form a latent magnetic imaging on the imaging member.

It is a further object of this invention to provide an improved method of forming a master for magnetic duplicating using a projection-speed optical imaging process.

It is still another object of the invention to provide a magnetographic imaging surface suitable for use in duplicating systems.

It is also an object of the invention to overcome the disadvantages of the prior art.

These and other objects are accomplished, generally speaking, by a magnetographic imaging member which includes a photoconductive layer sandwiched between a conductive transparent substrate and a thermal radiation absorbent overcoating of dielectric material having magnetically hard pigment therein. The magnetographic imaging member is imaged by uniformly premagnetizing the pigment in the dielectric coating in an alternating n-s stripe pattern which produces surface microfields and then forming a latent electrostatic image on the surface thereof. The latent electrostatic image is developed with a radiant heat reflective toner and the dielectric layer is subjected to radiant heating. The magnetic pattern in the magnetic pigment layer is erased when it is heated past its Curie point. The xerographic image developed with thermal radiation reflecting toner particles prevents the magnetic particles under the image from reaching their Curie point, leaving a magnetic latent image in the magnetic dielectric layer corresponding to the overlying xerographic toner pattern.

BRIEF DESCRIPTION OF THE DRAWINGS

For better understanding of the invention as well as other objects and further features thereof, reference is made to the following detailed disclosure of the preferred embodiments of the invention taken in conjunction with the accompanying drawings thereof, wherein.

DESCRIPTION OF THE PREFERRED EMBODIMENTS

Figure 1:
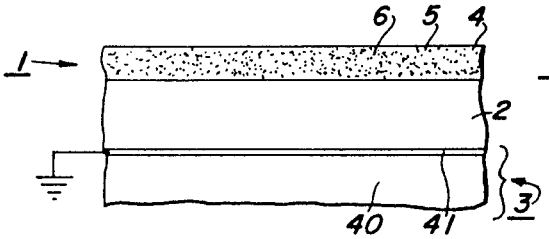
FIG. 1 is an enlarged, schematic cross-sectional view of the magnetographic imaging member of the present invention.

Referring more specifically to FIG. 1 there is shown in enlarged cross-section a portion of a magnetographic imaging member, generally designated 1, according to the present invention. Photoconductive layer 2 is sandwiched between transparent conductive substrate generally designated 3 and an overcoating, generally designated 4, which comprises a dielectric binder material 5 loaded with magnetically hard pigment particles 6.

The photoconductive layer 2 should be made from a material which is insulating in the dark and conductive when struck by activating radiation. It is preferably to use a sturdy, coherent photoconductive material which is easy to apply to substrate 3 and which lends itself readily to overcoating with the pigmented dielectric material 4. In cases where surface 1 is to be repetitively used, for example, in an automatic duplicating system, it is sometimes desirable that photoconductive layer 2 be made from a flexible material which can be conformed to allow member 1 to be shaped as a belt or scroll.

Any suitable such photoconductive material may be used. Typically, such suitable photoconductive layers include organic and inorganic photoconductors. Typical inorganic photoconductive materials include sensitized zinc oxide, for example, sensitized by the addition of rhodamine B dye, available from National Aniline Division; selenium, selenium alloyed with arsenic such as, for example, arsenic triselenide, tellurium, antimony or bismuth; cadmium sulfide, cadmium sulfoselenide, and the many other typical suitable inorganic photoconductive materials listed in U.S. Pat. No. 3,121,006, U.S. Pat. No. 3,288,603 and in U.S. Pat. No. 3,953,206.

Typical suitable organic photoconductive material include, for example, the combination of 2,5-bis(p-aminophenyl)-1,3,4-oxadiazole available from Kalle and Company, Wiesbaden-Biebrich, Germany and Vinylite VYNS, a copolymer of vinyl chloride and vinyl acetate, available from Carbide and Carbon Chemicals Company; and the complex of 2,4,7-trinitro-9-fluorenone with polyvinylcarbazole.

Preferred materials for photoconductive layer 2 are the complex of 2,4,7-trinitro-9-fluorenone with polyvinylcarbazole and also phthalocyanine (see U.S. Pat. No. 3,816,118) because of their relatively high sensitivity to light of a broad spectrum. The reason such light sensitivity is desirable will become clear in view of the description relating to the method of using surface 1 in connection with FIG. 3.

Transparent conductive substrate 3 generally comprises a transparent member 40 and a transparent conductive overlayer 41 and should be capable of transmitting imagewise visible radiation from a source outside surface 1 to photoconductive layer 2 without significant degradation of the image resolution due to light scattering.

Suitable materials for substrate 3 are well known in the art and include such materials as tin oxide coated glass (e.g. NESA glass, available from Pittsburg Plate Glass) and transparent metalized Mylar. In the use of the present invention, such substrates as NESA glass are preferred when surface 1 is to be a rigid member, e.g., a drum. Substrates such as chrome-plated or aluminized Mylar are more useful when surface 1 is to be used, for example, as a belt in a duplicating apparatus.

Overcoating 4 desirably comprises a dielectric material 5 capable of supporting a xerographic charge pattern for a period sufficient to allow development after latent image formation. It should be electrically insulating and, for most embodiments, capable of being imaged, cleaned and reused many times. It should be capable of containing a useful amount of magnetizable pigments without becoming excessively conductive.

As is well known from standard physics texts, the dielectric relaxation time "$\tau$", that is, the time required for the field across a dielectric to drop by a factor of 1/e, e being the base of the natural logarithms (2.718. . .), is related to the resistivity "$\rho$" and the dielectric constant "$\kappa$" by the equation $\tau=\epsilon_0\kappa\rho$, $\epsilon$ being a dimensional constant ($0.885 \times 10^{13}$ sec/ohm cm). For example, if $\rho=10^{13}$ ohm cm, $\tau=0.885\ \kappa$ (measured in seconds). The effective dielectric constant $\kappa_{eff.}$ of a composite comprising highly conductive spheres imbedded in a dielectric binder of dielectric constant $\kappa_b$ and resistivity $\rho_b$ may be determined by a formula due to Lord Rayleigh (Philosophical Magazine, Vo. 34, page 481, published in 1892): $\kappa_{eff.}=\kappa_b[1+3\times/(1-x)]$, $x$ being the volume fraction (packing fraction) of spheres. Typical plastic binders have values of $\kappa_b$ ranging from 2–3.5: for packing fractions of the order of 0.15–0.25, therefore, $\kappa_{eff.}$ will range from about 3–7. Since some preferred magnetic pigments such as $CrO_2$ are highly conductive (for $CrO_2$, $\rho=10^{-4}$ ohm.cm.) this formula may be used to approximate the dielectric properties of the composite. Automated xerographic processors presently require about 1–2 sec. or more between charging and development stations; therefore $\tau$ must exceed 1–2 sec., preferably 5 sec., and $\rho$ must exceed $3 \times 10^{12}$ and should preferably exceed $10^{13}$ ohm cm. No upper limit on $\tau$ is set by the process requirements.

Any suitable such dielectric overcoating material is useful. Typical of such suitable materials are polyesters, polyolefins, fluorocarbons, acrylics, alkyd resins, polycarbonates, polysulfones, polystyrene, polyphenyleneoxyde, polyphenylenesulfides and polyimides.

Magnetically hard pigment 6 should consist of a material which is capable of being finely divided and evenly dispersed in dielectric material 5. It should be magnetically hard; that is, it should be capable of retaining its magnetic properties, once it has been magnetized under ambient conditions, until it is deliberately re-magnetized by a suitably powerful source of magnetic energy, or until its temperature is elevated to above its Curie point.

Magnetically hard pigments of any suitable material are useful. Typically, such useful pigments include divalent chromium oxide, magnetite, iron, steels such as tungsten steel and carbon steel, nickel, cobalt, and other well known ferrite materials including alloys and ceramics.

Dark colored or black pigments are preferred because of their heat absorbing properties. The thermal radiation absorption characteristics of the magnetic material and of the reflected toner are important to that process step in which the xerographically developed image is converted into a magnetic latent image (see FIG. 3*f*). This step generally utilizes radiation in the visible and near infrared regions - particularly between about 0.4 and 1.5 $\mu$m in wavelength - the range predominantly emitted by commonly used tungsten lamps, xenon arcs, and flash lamps. The magnetic coating should be highly absorptive to such radiation, absorbing at least 70% and preferably over 90% of incident radiation. This requirement is well met by magnetic oxide coatings comprising chromium oxide, magnetite, and many other ferrites, which absorb, typically over 90% of incident radiation in the region in question. A useful reference, "Optical Properties of Pigments in the Near Infra Red" has been published by D. Taylor in *The Journal of the Oil and Colour Chemists' Association,* 41, No. 10, Oct. 1958.

A preferred group of pigments are those which, once magnetized, have a Curie point (erasure temperature) of not more than about 300° C. The use of higher temperatures in commercial machines is most times undesirable. Typical of such preferred materials are $CrO_2$, CrTe and MnAs. Suitable methods for the preparation of pure $CrO_2$ and of $CrO_2$ modified by reactants can be found, for example, in U.S. Pat. Nos. 2,956,955; 3,117,093; 3,074,778; 3,078,147; 3,278,263; 2,923,683; 2,923,684; 3,034,988; 3,068,176 and 2,923,685. Such compounds provide Curie erasure temperatures of from about 70° C to about 170° C. Such a temperature range is convenient for ordinary commercial use. U.S. Patent Nos. 3,555,556 and 3,554,788 to Nacci disclose typical temperatures and procedures suitable for ordinary commercial use.

Any suitable ratio of pigment to dielectric material may be used in overcoating 4. When the pigment is, for example, magnetite (density about 5.2) and is evenly dispersed in the overcoating, useful ratios are typically from about 10 vol.% to about 35 vol.% pigment. The physical integrity of the member is observed to be unsatisfactory at pigment concentrations below about 10 vol.%. At pigment concentrations of greater than about 35 vol.% conductivity of the dielectric layer sometimes becomes a problem.

A preferred concentration of pigment in the exemplary case of magnetite is from about 15 to about 25 vol.% in a uniform dispersion. Much lower concentrations of pigment, although useful, are sometimes magnetically weak. Much higher concentrations of pigment provide overcoatings which are brittle, sensitive to temperature and humidity, and, generally, are undesirably lacking in mechanical integrity.

However, in embodiments where the pigment in the overcoating is concentrated in a layer at the top of the dielectric layer the pigment can comprise as little as from about 0.2 to about 0.4 vol.% of the layer. One exemplary method of making such a configuration is disclosed in Example I, below. Another method useful in making such a layer is disclosed in U.S. Patent No. 3,956,524 to Weigl.

In order to achieve usefully high concentrations of magnetic pigment in the overcoating it is generally desirable to encapsulate the pigment particles in an insulating material prior to dispersing them in the dielectric overcoating material. Such encapsulation is generally more important when relatively conductive pigments are used, such as $CrO_2$. The encapsulation serves the important function of preventing direct electrical conduction between contacting particles by interposing a thin, protective barrier therebetween.

Any suitable dielectric encapsulating material may be used. Typical such materials are, for example, thermoplastics such as styrenebutylmethacrylate copolymer, vinyltolulene copolymer, acrylates, styrene-butadiene resins, polyamides, epoxy resins, and phenoxys.

Figure 2:
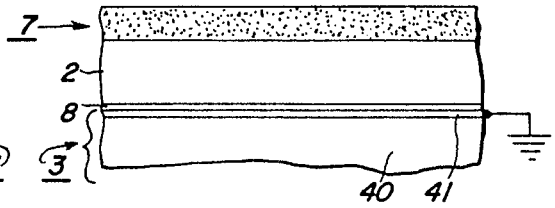
FIG. 2 is an enlarged, schematic cross-sectional view of the magnetographic imaging member of the present invention including an electrically insulating transparent barrier layer.

Referring now to FIG. 2 there is shown an enlarged cross-sectional view of magnetographic imaging member generally designated 7. In most respects, member 7 is like member 1; however, member 7 includes an injection barrier layer 8. Layer 8 is located between transparent conductive substrate 3 and photoconductive layer 2. Such barrier layers and their uses are well known in the art. They primarily serve to retard the dissipation of charge from a photoconductor in the dark by the injection of charge carriers from the base electrode. Such barrier layers serve to keep the charge retention time of the composite photoreceptor as close as possible to the theoretical limit imposed by the dielectric relaxation time resultant from the dielectric's bulk resistivity and dielectric constant.

Barrier layer 8 should be sufficiently insulating to retard charge flow from photoconductive layer 2 to conductive substrate 3 in the dark. Layer 8 should also be sufficiently transparent to allow imagewise radiation to strike photoconductive layer 2 without significantly diminishing the resolution or intensity of the light.

Materials suitable for use as barrier layers are well known in the art and typically include very thin layers of such materials as aluminum oxide, polyvinyl acetate epoxy ester resin, cellulose nitrate and many others as disclosed, for example, in the commonly assigned copending application U.S. Pat. Ser. No. 437,574, now abandoned, filed Jan. 29, 1974; and U.S. Pat. No. 2,901,348 to Dessauer et al.

Referring more specifically to FIGS. 3*a–h*, there is shown an exemplary method of practicing the present invention using the magnetographic imaging surface shown in FIGS. 1 or 2.

Figure 3A:
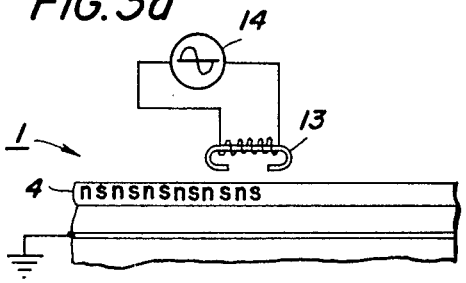
FIGS. 3*a-h* show schematically and in cross-section a method for forming a magnetic latent image in the magnetographic imaging member of the present invention.

The first step in the process of forming a magnetic latent image according to the present invention is to provide a uniformly pre-magnetized layer of pigment particles in overcoating 4 as shown in FIG. 3*a*. Any suitable well known method may be used for uniformly magnetizing the pigmented layer in an alternating *n–s* stripe pattern to produce surface microfields. In FIG. 3*a* the pigment in overcoating 4 is magnetized in alternately polarized micro-bands by passing magnetic recording head 13 across the surface of the overcoating. The recording head is electrically connected to A.C. power source 14. Overcoating 4 is thus uniformly magnetized.

The next step is the formation of an electrostatic latent image or charge pattern on the top side of surface 1. Methods of forming such a xerographically developable charge patterns are well known in the art and include the methods taught by Steinhilper in U.S. Pat. No. 2,955,938 and by Hall in U.S. Pat. No. 3,234,019. Other useful methods for forming a charge pattern on overcoating 4 are taught by K. Nakamura in "Electrophotographic Processes Using a Dielectric Layer Bonded to a Photoconductive Layer As In The Katsuragawa Process" *IEEE Transactions On Electron Devices,* Vol. ED. 19, No. 4, April 1972; by M. Mitsui in "Canography in Electrophotography" *IEEE Transactions On Electron Devices,* Vol. ED. 19, No. 4, April 1972; by P. Mark in "A Comparison of Some Electrophotographic Processes Based on Photoconductor Insulator Combinations", *Photographic Science and Engineering,* Vol. 18, No. 3, May/June 1974.

Figure 3B:
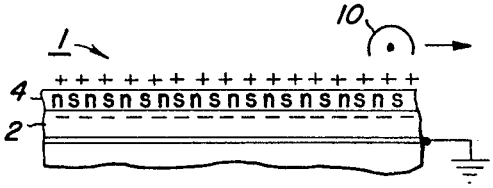
Figure 3C:
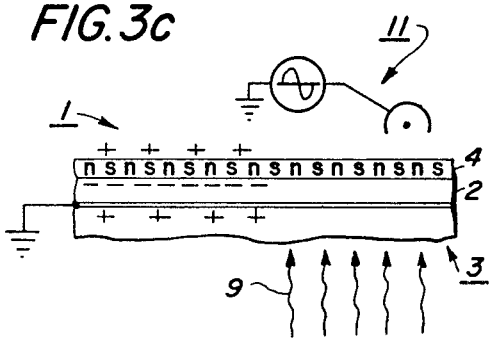

In FIG. 3*b*, overcoating 4 is uniformly charged by corotron 10 and a charge of the opposite polarity is induced at the interface between insulating overcoating 4 and the photoconductive layer 2. Subsequently, as shown in FIG. 3*c*, layer 1 is subjected to an imagewise light pattern 9. Light pattern 9 strikes photoconductive layer 2 by passing through transparent conductive substrate 3. The impinging of light pattern 9 on photoconductive layer 2 occurs simultaneously with the A.C. discharging of the top surface of overcoating 4 by A.C. corona device 11, set at an average potential of zero (ground).

In the portion of layer 1 corresponding to light pattern 9 the primary charge on the top of overcoating 4 is eliminated by A.C. corona discharge 11. In the non-light-struck area, the primary charge on the top of overcoating 4 is only slightly discharged and nearly all the charge remains.

Figure 3D:
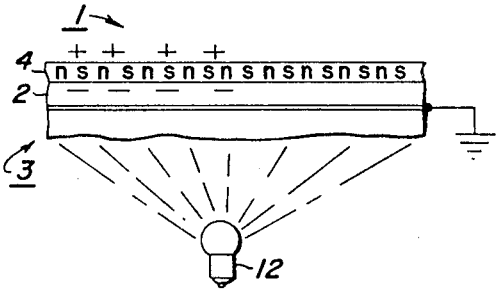

As shown in FIG. 3*d*, surface 1 is then uniformly exposed to light 12 which eliminates the field across photoconductive layer 2 in the image (dark) area but leaves a stable charge pattern on the top of insulating overcoating 4.

Figure 3E:
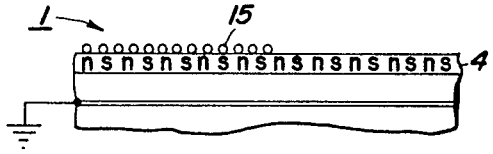

As shown in FIG. 3*e*, the charge pattern which remains on the top surface of overcoating 4 is xerographically developed using a thermal radiation reflective toner 15. Any useful development method may be used. Suitable methods for developing latent electrostatic images or charge patterns with particulate developer material are well known in the art and are exemplified by the disclosures of U.S. Pat. No. 2,618,552 to Wise; U.S. Pat. No. 2,638,416 to Walkup; and U.S. Pat. No. 2,221,776 to Carlson. Suitable methods for the liquid development of the charge pattern are typified by the method disclosed in U.S. Pat. Nos. 2,907,674 and 2,913,353.

Thermal radiation reflective toner particles 15 are used to develop the charge pattern. Any useful thermal radiation reflective toner may be used. Typically useful toners are powdered ZnO and $TiO_2$ based dry and liquid toners. Aluminum flake toners may also be used, for example, as electrophoretic liquid developers.

For a good contrast, the reflective toner pattern should reflect at least 70% and preferably over 80% of the incident radiation. This requirement is well fulfilled by white pigments such as $TiO_2$, ZnO, $BaSO_4$, $BaCo_3$ and $MgCO_3$ which are typically used in white paints and reflective paper coatings. Alternatively, lightly colored reflective pigments such as chrome yellow and organic yellows may be utilized as well as retro-reflective glass micro-beads, and specularly reflective metallic pigments such as aluminum flake and light-colored "bronze" pigments. All the pigments mentioned are readily incorporated in xerographic dry or liquid-suspension toners, and many examples of such toners appear in the technical literature.

Figure 3F:
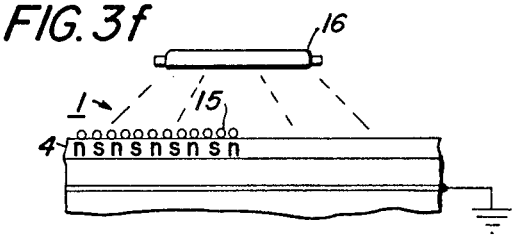

At this point, the pigment in overcoating 4 is still uniformly magnetized in a *n–s* stripe pattern. Next, as is schematically shown in FIG. 3*f*, overcoating 4 is heated to a temperature above the Curie point of the pigment. Although any of the well known heating methods and devices may be used, a xenon flash lamp 16 is shown as heating overcoating 4 in FIG. 3*f*. Xenon flash lamps are often considered desirable for such applications because they are capable of producing useful temperatures quickly.

Curie point temperatures vary somewhat for different materials. Some materials have inconveniently high Curie point temperatures, such as $Fe_3O_4$ which has a Curie point temperature of about 555° C. The most useful materials are those which have Curie point temperature from about 70° C to about 170° C, because inexpensive plastic films, such as Mylar, are dimensionally stable at these temperatures.

Heat reflective toner 15 reflects heat from xenon flash lamp 16 so that the portion of overcoating 4 which lies under reflective toner 15 is not demagnetized. The portion of overcoating 4 which is not protected by reflective toner 15 is heated to above the Curie point of the magnetic pigments therein, and the magnetism in the pigment is erased. This process is known as Curie point erasure.

A magnetic latent image is thus formed in overcoating 4 corresponding to the electrostatic latent image of FIG. 3*d*.

Figure 3G:
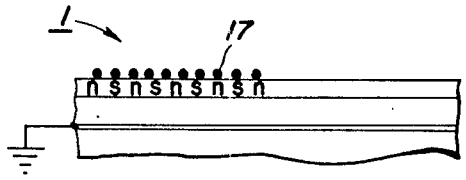

As shown in FIG. 3*g* the magnetic latent image is developed with a magnetically attractable toner 17 by any well known process. Useful magnetic development processes and materials are described in the Rait et al patents, mentioned above, and are well known in the art. Magnetic toners may usefully include magnetically attractable particles, such as ferrites, encapsulated in thermoplastic resins. Such encapsulated magnetic toners are useful when the toner is sought to be fixed to a substrate as by heating.

Figure 3H:
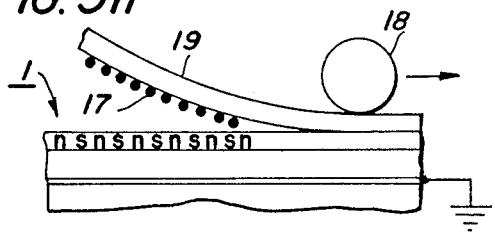

The transfer of the developed magnetic toner to a substrate is shown in FIG. 3*h* where the toner particles 17 are transferred by pressure exerted through pressure roll 18 to a receiving material 19, such as paper.

It will be clear to those skilled in the art that there are many useful variations of the process shown in FIGS.

3*a–h* which are within the scope of the invention. For example, other heating sources are commonly available for Curie point erasure.

Figure 4:
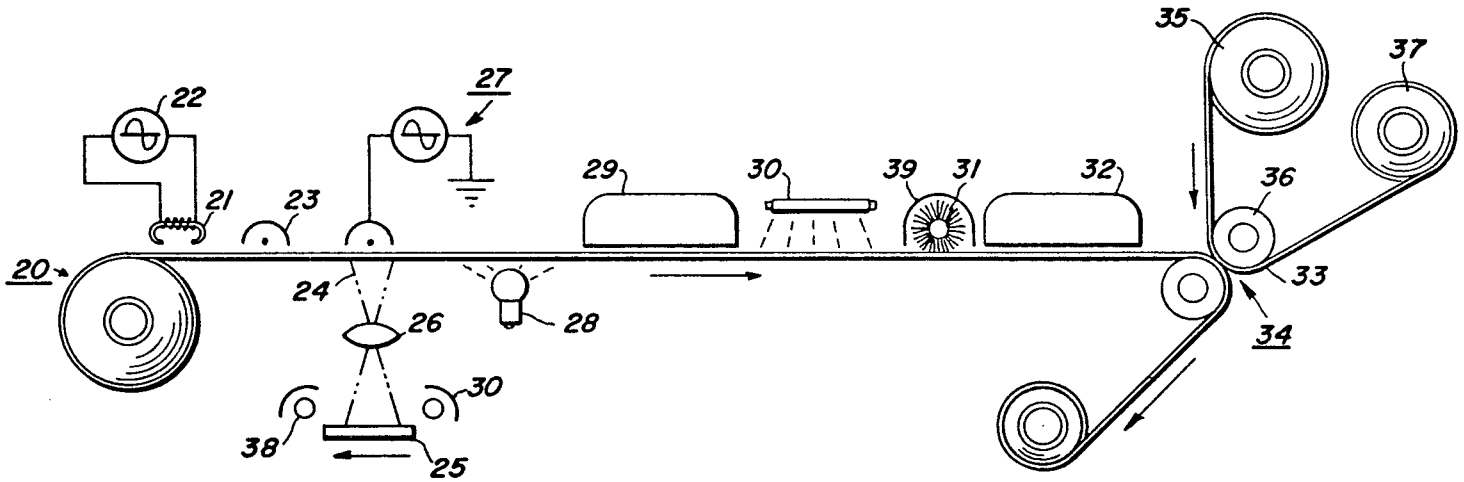
FIG. 4 shows schematically and in cross-section an automatic duplicating device employing the magnetographic imaging member of the present invention and the method of it use therein.

Referring now to FIG. 4 there is shown in schematic cross-section an exemplary embodiment of the magnetographic imaging surface of the present and the method of its use in a magnetographic duplicating system.

The magnetographic imaging member, generally indicated as 20, is a scroll shaped member having a construction similar to that shown in FIG. 2 with a flexible transparent conductive substrate such as aluminized Mylar. If member 20 were to be used in a similar drum type duplicating system the substrate could be, for example, tin oxide coated glass.

Member 20 is uniformly magnetically charged by a magnetic recording head 21 connected to A.C. power source 22.

As the scroll unwinds in the direction shown by the arrow surface 20 is uniformly charged by corotron 23. Surface 20 is then imagewise exposed from the bottom side to reflected light pattern 24 from original 25 through lens system 26 while it is simultaneously subjected to an A.C. corona 27 from the top side. Original 25 is illuminated by lamps 38 as it moves past lens system 26 in the direction shown by the arrow synchronously with the movement of surface 20 in the opposite direction. As is common in such devices original 25 is scanned through lens system 26 synchronously with the movement of member 20 so that an image pattern of high resolution impinges member 20. After imagewise exposure, the member 20 is flood illuminated by light source 28 to stabilize the charge pattern on the top side of member 20 as in FIG. 3*d*, above.

The charge pattern on the top side of member 20 is developed with a heat reflective xerographic developer such as $TiO_2$ by cascade development device 29. The developed image is exposed to xenon flash lamp 30 so that the magnetized pigment in member 20 is raised to a temperature above its Curie point and demagnetized except in the areas where the heat from lamp 30 is reflected by the heat reflective toner. A magnetic latent image is thus formed in surface 20 corresponding to the image reflected from original 25.

The xerographic image is cleaned from member 20 by brush cleaner 31. Cleaning is assisted by vacuum nozzle 39 which cleans the xerographic toner from brush 31. The magnetic latent image is developed with a magnetically responsive toner at magnetic development station 32.

The developed magnetic image is transferred to a receiving member 33, such as paper, at the transfer station generally designated 34. Receiving member 33 is unwound from supply roll 35 and passes between member 20 and pressure roller 36. The developed magnetic image is transferred to receiving member 33 which is collected by take up roll 37.

Member 20 can be used to redevelop and transfer as many subsequent copies of a particular latent magnetic image as are desired. Alternatively, a new and/or different latent magnetic image can be produced and developed and each cycle.

Methods of making the megnetographic imaging surface of the present invention will now be described by way of example by which other useful embodiments and procedures will become clear to those skilled in the art.

EXAMPLE I $CrO_2$, a black, magnetically hard pigment having an average width of 0.1 micron, an average length of 1 micron and a density of about 4.9g/cc, commercially available from DuPont, is imbedded in an insulating copolymer comprising 65wt.% styrene and 35wt.% n-butylmethacrylate. The overcoating is prepared by mixing about 15vol.% $CrO_2$ with the copolymer in a Banbury mixer for about 10 minutes at about 200° F.

The mixture is then placed in a rubber mill with a gap setting of about 0.034 inch with cooling. It is repeatedly passed through the rubber mill rollers for about 15 minutes. The mixture of $CrO_2$ and copolymer is cooled and put in a Fitzmill where it is broken into one eighth inch kernels after which it is further reduced in size by jet attritron until a particle size of from about 10–15 microns is achieved.

A NESA glass substrate is coated by vacuum evaporation with a 4 mil thickness of selenium and then laminated with a 3 mil adhesive coated polyethylene terephthalate film such as Mylar, available from DuPont. The 10–15 micron particles are dispersed in alcohol (a non-solvent) and spread on the Mylar. After the alcohol has dried, the particles are heat fused into a continuous layer, 0.5 mil thick, on the surface of the Mylar.

The magnetographic imaging surface is tested by subjecting it to the process steps shown in FIGS. 3*a–g*. A positive, black magnetic toner image of high resolution is developed from the magnetic latent image so formed. The image is transferred to paper as shown in FIG. 3*h*, and is then heat fused to the paper. The magnetic toner used is 3M's type 355 toner applied by the development apparatus from a 3M VQC copier.

EXAMPLE II

The conductive substrate coated with selenium and the 10–15 micron particles are prepared as in Example I.

In Example II a copolymer of polyvinylacetate and crotonic acid is dissolved in 3% ammoniated water to form the corresponding ammonium salt of the copolymer. The 10–15 micron particles are suspended in the water solution in an amount sufficient to achieve a 10 vol.% concentration of $CrO_2$. The dispersion is coated onto the photoreceptor in a sufficient thickness to result in a 1 mil coating when dried.

The magnetographic imaging surface of Example II is tested as in Example I and substantially the same results are observed.

EXAMPLE III

A NESA glass substrate is coated with a phthalocyanine binder composition prepared by mixing 12 grams of an epoxy phenolic resin and one gram *x*-form metal-free phthalocyanine. The resin/phthalocyanine mixture is formulated together with 3.5 grams phthalic anhydride, 9 grams n-butanol and 15 grams of acetone. The mixture is milled for about eight hours with procelain pebbles in a 6-ounce mixing vessel. The resulting mixture is deposited on the NESA glass with a No. 40 drawdown rod. The coating is cured for about 60 minutes at about 175° C.

A more detailed discussion of this method for coating a photoconductive binder layer on a substrate is found in U.S. Pat. No. 3,816,118.

To provide the magnetic dielectric coating, about 42 g. of $CrO_2$ powder is combined with 51.3g. ERL2795 liquid epoxy resin, available from Union Carbide. The $CrO_2$ is dispersed in the resin in a pebble mill for 2 hours. After dispersion is achieved, about 23.1 g. of Versamid 140, (curing agent), a polyamide resin available from General Mills, is added to the dispersion with stirring.

The dispersion is coated onto the phthalocyanine photoreceptor to a 1.5 mil thickness, and the coating is cured for about 80 minutes at about 200° F to produce a composition comprising about 11.2% by volume of $CrO_2$.

The magnetographic imaging surface of Example III is tested as in Example I and substantially the same results are observed.

EXAMPLE IV

A mixture of 30 g. $CrO_2$ pigment and 10g. styrene-butylmethacrmethacrylate copolymer resin are mixed together. The mixture is processed as described in Example I, above, to form 10–15 micron sized particles comprising 39 vol.% of magnetic material. About 6g of the particles are combined with about 2.7g. of ERL-2795 liquid epoxy resin. The materials are dispersed in a pebble mill until a uniform pigment slurry is obtained. About 2.7g. of Versamid 140 (curing agent) is added to the dispersion with stirring. The dispersion is applied to a phthalocyanine photoreceptor made as described in Example III to a 2.5 mil thickness and is cured for about 80 minutes at about 200° F to produce a composition comprising about 30% by volume $CrO_2$.

Good results are observed when the magnetographic imaging surface of Example IV is tested as described in Example I.

It will be appreciated that other variations and modifications will occur to those skilled in the art upon reading of the present disclosure. These are intended to be within the scope of this invention.

What is claimed is:

1. A method for forming a magnetic latent image which comprises the steps of:
   (a) providing an imaging member comprising a photoconductive layer sandwiched between a transparent conductive substrate and an overcoating which comprises a dielectric material having a pre-magnetized magnetically hard pigment dispersed therein;
   (b) forming an electrostatic latent image on the overcoating,
   (c) developing the electrostatic latent image with a radiant heat reflective toner; and
   (d) exposing the imaging surface to radiant heat sufficient to elevate the temperature of the pigment above its Curie point in the portions of the overcoating where the radiant heat is not reflected by the toner, whereby a latent magnetic image remains in the overcoating corresponding to the developed electrostatic latent image.

2. The method of claim 1 which includes the additional step of developing the magnetic latent image with a magnetic developer.

3. The method of claim 2 which includes the additional steps of transferring the developed image to a receiving surface and developing the magnetic latent image with a magnetic developer at least one additional time.

* * * * *